United States Patent [19]

Sakuma et al.

[11] 4,434,331

[45] Feb. 28, 1984

[54] VACUUM POWER INTERRUPTING DEVICE

[75] Inventors: Shinzo Sakuma, Yokohama; Hifumi Yanagisawa, Sagamihara; Kazuo Tokuhata, Yamanishi; Hiroshi Miyagawa, Yokohama, all of Japan

[73] Assignees: Kabushiki Kaisha Meidensha; Kabushiki Kaisha GEMV AC, both of Tokyo, Japan

[21] Appl. No.: 230,286

[22] Filed: Jan. 30, 1981

[30] Foreign Application Priority Data

Feb. 4, 1980 [JP] Japan ..... 55-12181

[51] Int. Cl.[3] ..... H01N 33/66

[52] U.S. Cl. ..... 200/144 B; 335/151

[58] Field of Search ..... 200/144 B; 335/151

[56] References Cited

U.S. PATENT DOCUMENTS

| | | | |
|---|---|---|---|
| 3,562,682 | 2/1971 | Ohwada | 335/201 |
| 3,812,314 | 5/1974 | Nonken | 200/144 B |
| 3,855,435 | 12/1974 | Himi | 200/144 B |
| 4,365,127 | 12/1982 | Sakuma | 200/144 B |

FOREIGN PATENT DOCUMENTS

| | | | |
|---|---|---|---|
| 37162 | 10/1981 | European Pat. Off. | 200/144 B |
| 1020081 | 11/1958 | Fed. Rep. of Germany | 200/144 B |
| 96605 | 3/1973 | Fed. Rep. of Germany . | |
| 128192 | 11/1977 | Fed. Rep. of Germany | 200/144 B |
| 1405144 | 9/1975 | United Kingdom | 200/144 B |

*Primary Examiner*—Robert S. Macon

*Attorney, Agent, or Firm*—Lowe, King, Price & Becker

[57] ABSTRACT

A vacuum vessel 17 comprises a bell shaped metallic casing 20, and an insulating circular end plate 21 hermetically brazed to the opening end of the metallic casing 20. A vacuum interrupter 2 is constituted by aligning a stationary contact rod 27 with a movable contact rod 25, each having an electrical contact 18, 19 within the vessel so that the latter is in contact with the former or away therefrom. A vacuum power interrupting device comprises an insulating block 4 mounted on the vacuum interrupter so that the outer surface of the insulating end plate 21 attached to the opening end of the vacuum interrupter is pressed onto the insulating block through a sealing member 11.

12 Claims, 4 Drawing Figures

VACUUM POWER INTERRUPTING DEVICE

BACKGROUND OF THE INVENTION

The present invention relates to a vacuum power interrupting device, and more particularly but not exclusively to a vacuum power interrupting device adapted to be mounted on a power board or a swtiching board.

In U.S. Pat. No. 4,365,127, there has been proposed a vacuum power interrupter comprising a vacuum vessel consisting of a bell shaped metallic casing, and an insulating end plate of ceramic hermetically brazed to the opening end of the metallic casing, and a pair of contact rods disposed within the vacuum vessel so that one is in contact with the other or away therefrom.

This type of the vacuum power interrupter makes it easy to enlarge an outer radius of the vacuum vessel for an interrupter capable of interrupting a large electric current, as compared with a second type of the vacuum power interrupter comprising a cylindrical insulating envelope, metallic end plates hermetically brazed to the axial ends of the insulating envelope, respectively, and stationary and movable contact rods disposed within the insulating envelope so that the latter is movable relative to the former.

The first type of the vacuum power interrupter further is easy to fabricate and is inexpensive because of the fact that the insulating end plate of ceramic is used instead of an insulating envelope of ceramic which is costly.

However, with the first type of vacuum power interrupter, the following drawback is pointed out:

The area of the insulating end plate is small as compared with that of the insulating envelope. As a result, the flash-over path through an air path or tracking path over a solid surface of the insulating end plate is small. Accordingly, the insulating withstanding voltage becomes small, resulting in that the insulating withstanding voltage is smaller than that of the second type of the vacuum power interrupter. As a result, the first type of the vacuum power interrupter makes it difficult to interrupt a high voltage.

SUMMARY OF THE INVENTION

With the above in mind, an object of the present invention is to provide a vacuum power interrupting device which makes it possible to improve the flash-over voltage at an outer surface of an insulating circular end plate of a ceramic constituting a vacuum interrupter.

Another object of the present invention is to provide a vacuum power interrupting device capable of interrupting a high voltage.

A further object of the present invention is to provide a vacuum power interrupting device which can be made in a form to be mounted on a power-board or a switching board.

One aspect of the present invention is as follows: A vacuum power interrupting device with a vacuum vessel comprising a bell shaped metallic casing, and an insulating circular end plate hermetically brazed to the opening end of the metallic casing, wherein a vacuum interrupter is constituted by aligning a stationary contact rod with a movable contact rod, each having an electrical contact provided on the extended end thereof, within the vacuum vessel so that the latter is in contact with the former or away therefrom, characterized in that the vacuum interrupter is mounted on an insulating block so that the outer surface of the insulating end plate attached to the opening end of the vacuum interrupter is pressed onto the insulating block through a sealing member. The advantage offered by the invention is mainly that the flash-over voltage at the end plate is improved.

Another aspect of the invention is as follows: The vacuum power interrupting device is characterized in that the vacuum interrupter is disposed between a clamping member and the insulating block, whereby the vacuum interrupter is fastened to the insulating block by a pressing force applied to the clamping member.

A further aspect of the present invention is as follows: The vacuum power interrupting device is characterized in that the vacuum power interrupter is designed so that its operational mode is shifted from a self-closed condition to an interrupted condition depending on the deeneragization or energization of an electromagnet constituting an actuating unit or mechanism.

BRIEF DESCRIPTION OF DRAWINGS

One way of carrying out the invention is described in detail below with reference to drawings which illustrate only one specific embodiment, in which.

In these drawings, same reference numerals denote same or similar parts of the vacuum power interrupting device according to the present invention.

DETAILED DESCRIPTION OF THE PREFERRED EMBODIMENT

Figure 1:
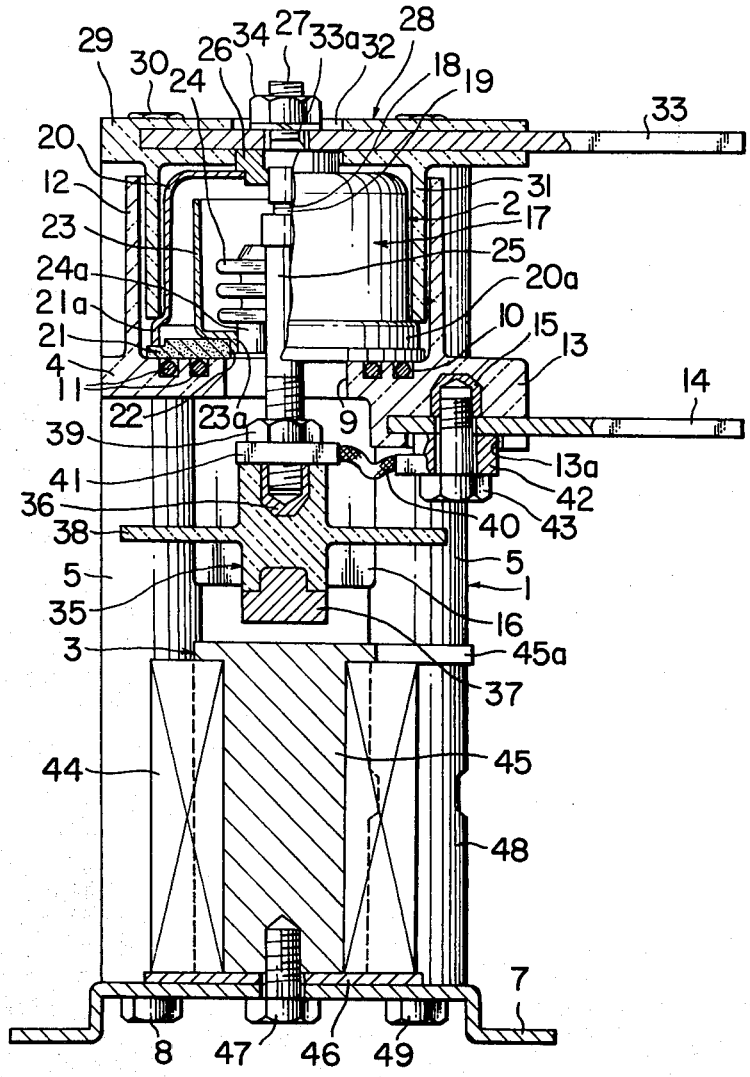
FIG. 1 is a longitudinal cross sectional view illustrating a preferred embodiment of a vacuum power interrupting device according to the present invention.

Referring to FIG. 1, there is illustrated one form of a vacuum power interrupting device according to the present invention. The vacuum power interrupting device briefly comprises an insulating supporting member 1 of a resin, a bell shaped vacuum interrupter 2 mounted on the insulating supporting member 1 by any suitable method which results in the interrupter being pressed against the member 1, and an actuating mechanism 3 for effecting an opening operation of the vacuum interrupter 2, disposed within the insulating supporting member 1, each of which is described later in greater detail.

Figure 2:
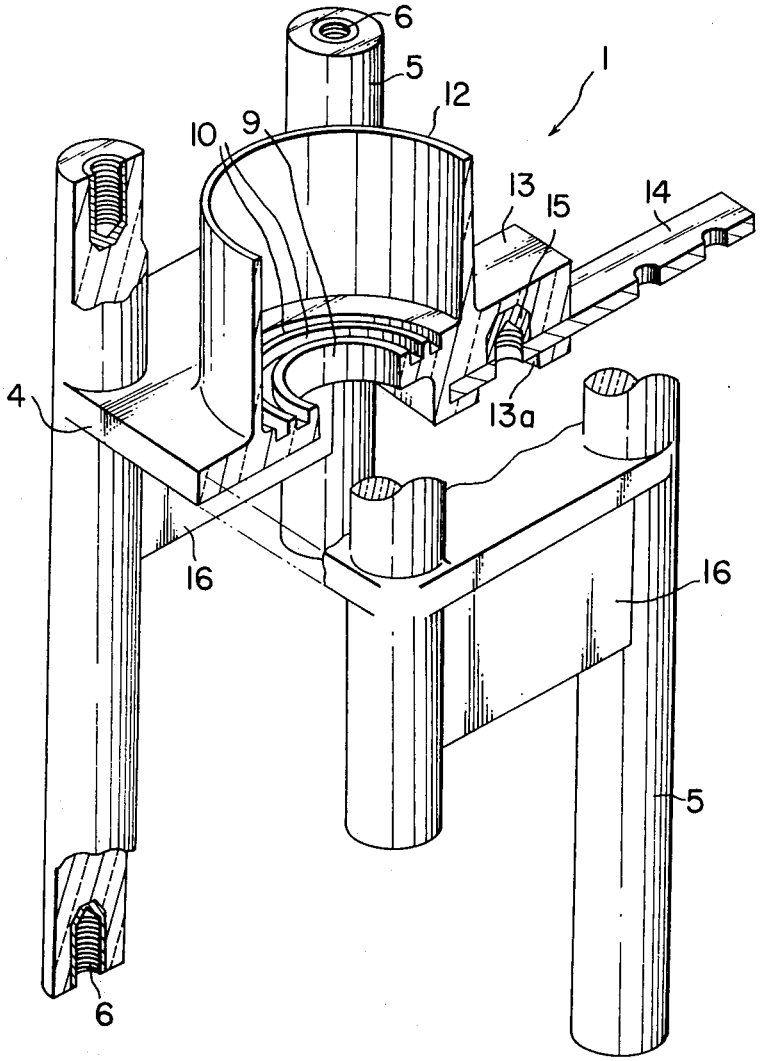
FIG. 2 is a perspective view illustrating an insulating block, an insulating barrier, and a plurality of supporting poles shown in FIG. 1.

The insulating supporting member 1 is made of a synthetic resin, such as premix or epoxy resin formed by molding. As best seen from FIG. 2, the insulating supporting member 1 comprises a rectangular shaped supporting portion 4 for mounting the vacuum interrupter 2 thereon, and four supporting poles 5 integrally formed with the supporting portion 4 extending along each corner of the supporting portion 4. The upper portion of each supporting pole 5 positioned above the supporting portion 4 is shorter than that of the lower portion positioned below the supporting portion 4. The length of each lower portion among two pairs of supporting poles 5 positioned along each diagonal line is different as shown in FIG. 2. A metal fitting 6 with a screw-threaded portion is embedded in each end of the supporting pole 5. One pair of supporting poles 5 each of which lower portion is longer than that of the other pair of supporting poles 5 is provided at the end thereof with a mounting metal fitting 7 of a magnetic material (see FIGS. 1 and 4). The mounting metal fitting 7 is provided for mounting the supporting member 4 to a board-plate (not shown) and attaching the actuating mechanism 3 thereto. The metal fitting 7 is screw-threadedly connected to the metal fitting 6 by means of a bolt 8.

As shown in FIG. 2, the supporting portion 4 of the insulating supporting member 1 is provided in the center thereof with a bore 9 for permitting a movable contact rod (which will be referred to later) of the vacuum interrupter 2 to be conducted thereinto. The supporting portion 4 is further provided along the periphery of the bore 9 with a plurality of grooves 10 exposed to the upper portion of the supporting portion 4 so that each groove is disposed concentrically. A sealing ring 11 (see FIG. 1) of polyethylene propylene rubber (EPR) or silicon rubber is fitted into each groove 10 so that the upper portion thereof projects from the upper end of the supporting portion 4 for a predetermined distance. An adhesive material (not shown) of polybutadiene rubber system for adhering an insulating circular end plate (which will be referred to later) thereto is coated on the supporting portion 4 positioned between grooves. A cylindrical insulating barrier 12 is integrally formed along the periphery of the groove 10 positioned close to the most outer portion thereof in the radial direction. Further, between two supporting poles 5, which are adjacent to each other, of the supporting portion 4, a rectangular shaped electrical lead supporting portion 13 which projects in the right direction thereof in FIG. 1 is integrally formed with the supporting portion 4. In the electrical lead supporting portion 13, the bottom portion of the electrical lead 14 on the side of the movable contact rod, which is made of Cu or Cu alloy, is embedded together with a metal fitting 15 with a screw-threaded portion. The end of the electrical lead 14 is adapted to be connected to a power supply or a load. The electrical lead 14 extends in the direction perpendicular to the supporting pole 5, wherein a part of the bottom portion thereof is exposed into a bore 13*a* provided in the electrical lead supporting portion 13.

In FIG. 2, reference numeral 16 denote an insulating barrier integrally formed between supporting poles 5 adjacent to each other on the both sides of the electrical lead 14.

Within the cylindrical insulating barrier 12 of the insulating supporting member 1, as shown in FIG. 1, the aforementioned bell shaped vacuum interrupter 2 is accomodated. The vacuum interrupter 2 is constituted so that its closing operation is effected in accordance with the pressure differentials between the inside thereof and the outside thereof. The vacuum interrupter 2 comprises a bell shaped vacuum vessel 17, and stationary and movable electrical contacts 18 and 19 disposed within the vacuum vessel 17 so that the latter is movable relative to the former.

Reference is made to a method of making a vacuum vessel 17.

The method comprises the steps of providing a radially extended portion 20*a* extending outwardly in the vicinity of an opening end of the bell-shaped metal casing 20 of Fe-Ni-Co alloy or Fe-Ni alloy, hermetically brazing the insulating circular end plate 21 of ceramic to the opening periphery of the radially extended portion 20*a* through a step portion 21*a* formed along the outer periphery thereof, and evacuating the interior thereof to the degree of high vacuum. The insulating end plate 21 of the vacuum vessel 17 is provided in the center thereof with a bore 22. A cylindrical arc-shield member 23 of Fe-Ni-Co alloy or Fe- Ni alloy disposed concentrically with the vacuum vessel 17 is fitted into the bore 22 through a tubular portion 23*a* extending outwardly in the axial direction from the center of the bottom thereof. A part of the bottom of the arc-shield member 23 is hermetically brazed to the insulating circular end plate 21. A bellows 24 of stainless steel or inconel is concentrically disposed within the vacuum vessel 17. The bellows 24 is provided at the bottom portion thereof with a tubular portion 24*a* extending outwardly in the axial direction of the vacuum vessel 17. The tubular portion 24*a* of the bellows 24 is fitted into and hermetically brazed to the tubular portion 23*a* of the arc-shield member 23.

The movable contact rod 25 of Cu or Cu alloy is fitted into and brazed to the center of the bottom of the bellows 24. The movable electrical contact 19 of Cu or Cu alloy is brazed to the inner end of the movable contact rod 25 projecting into the vacuum vessel 17. A circular auxiliary metal fitting 26 is fitted into or hermetically brazed to a bore provided in the center of the bottom of the metal casing 20. An auxiliary metal fitting 26 is provided for improving the efficiency of collecting electricity. The auxiliary metal fitting 26 is made of Cu or Cu alloy. The stationary contact rod 27 of Cu or Cu alloy is fitted into the center thereof and hermetically brazed thereto. The stationary electrical contact 18 of Cu or Cu alloy which is in contact with the movable electrical contact 19 or away therefrom is brazed to the extended end of the stationary contact rod 27.

Reference is made to a method of mounting the aforementioned vacuum interrupter 2 to the insulating supporting member 1. The method comprises the steps of inserting the movable contact rod 25 into the bore 9 of the insulating supporting member 1, mounting the insulating end plate 21 on sealing rings 11 so as to become in contact therewith, and accommodating the metal casing 20 within the cylindrical insulating barrier 12 provided on the insulating supporting member 1 so that the bottom portion of the metal casing 20 projects for a predetermined distance from the upper end of the cylindrical insulating barrier 12. The vacuum interrupter 2 is mounted on the supporting portion 4 so that it is pressed onto the insulating supporting portion 4 of the insulating supporting member 1 by means of a clamping member 28 mounted on the upper end of the supporting pole 5.

Figure 3:
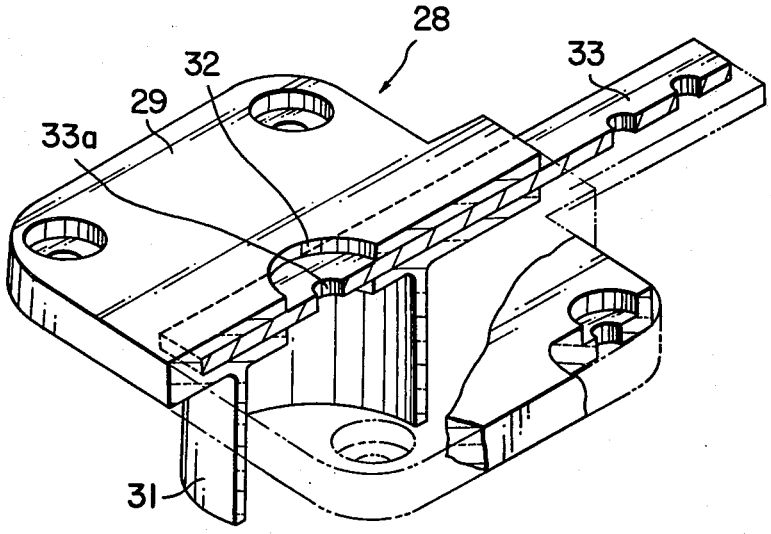
FIG. 3 is a perspective view illustrating a clamping member shown in FIG. 1.

The clamping member 28 is made of synthetic resin which is the same material as the insulating supporting member 1. As shown in FIGS. 1 and 3, the clamping member 28 includes a rectangular mounting portion 29. The rectangular mounting portion 29 is provided at each corner thereof with a bore 29*a*. The clamping member 28 is mounted on the supporting pole 5 by screw-threadedly connecting a bolt 30 to the bore 29*a*. On the one side of the mounting portion 29, a cylindrical retaining member 31 serving as an insulating barrier is integrally formed. The retaining member 31 is provided for retaining or pressing the vacuum interrupter 2 with respect to the supporting portion 4 of the insulating supporting member 1. The retaining member 31 is constituted so that its radius is smaller than that of the cylindrical insulating barrier 12 of the supporting member 1 and longer than outer radius of the metallic casing 20 of the vacuum interrupter 2. The end portion of the retaining member 31 is provided so as to become in contact with the radially extended portion 20*a* of the metallic casing 20. The retaining member 31 is provided so that its length is longer than the length from the bottom of the metallic casing 20 to the radially extended portion 20*a*. At the position corresponding to the center of the retaining member 31 integrally formed with the mounting portion 29 of the clamping member 28, there is provided a bore 32. The second electrical lead 33 of which the bottom portion is embedded in the mounting portion 29 is exposed at the position at which the bore 32 is provided.

The second electrical lead 33 extends in parallel with the first electrical lead 14. The end portion of the second electrical lead 33 projects in the same direction as the end portion of the first electrical lead 14 and is adapted to be connected to a power supply or a load. The second electrical lead 33 is provided at the position exposed to the bore 32 of the clamping member 28 with a bore 33*a* positioned concentrically with the bore 32. The stationary contact rod 27 of the vacuum interrupter 2 is inserted into the bore 33*a*. A nut 34 is fitted over the end portion of the stationary contact rod 27 projecting form the stationary electrical lead 33. The auxiliary metal fitting 26 is fitted into the portion exposed to the bore 32 of the second electrical lead 33 in order to improve the efficiency for collecting electricity.

Figure 4:
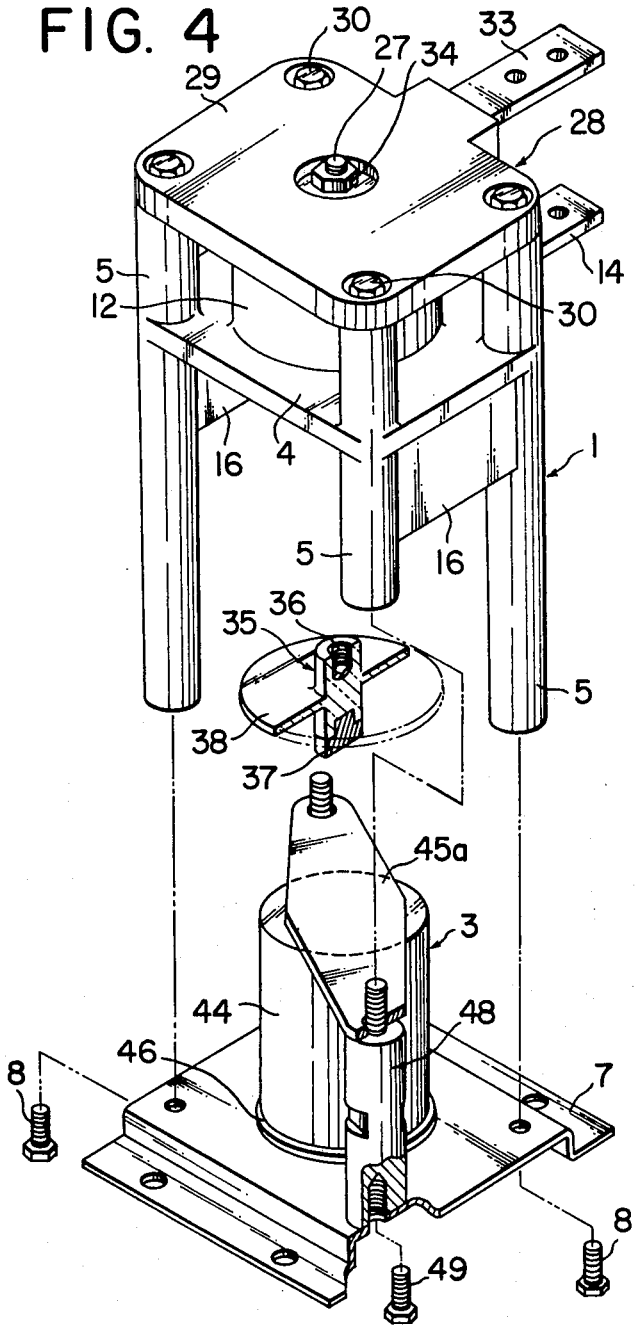
FIG. 4 is an exploded perspective view schematically illustrating the vacuum power interrupting device shown in FIG. 1.

To the outer portion of the movable contact rod 25 of the vacuum interrupter 2, as shown in FIGS. 1 and 4, the insulating resin block 35 formed by means of molding is screw-threadedly connected through a metal fitting 36 embedded in the central portion thereof. The insulating resin block 35 is provided for effecting an electric insulation between the movable contact rod 25 and the actuating mechanism 3 for moving the movable contact rod 25 in the axial direction (which will be referred to).

An amature 37 of magnetic material is embedded on the other end of the insulating resin block 35. The insulating resin block 35 is further provided in the middle portion thereof integrally with an annular flange 38 for increasing the surface creepage withstanding voltage. The insulating resin block 35 is screw-threadedly connected to the movable contact resin block 35. The insulating rod 35 is fixed at a desired position by means of a lock nut 39. Thus, the insulating resin block 35 is movable toward the movable contact rod 25.

Between the lock nut 39 and the one end of the insulating resin block 35, there is provided a ring shaped connecting metal fitting 41 to which the one end of the flexible electrical lead 40 for connecting the movable contact rod 25 with the first electrical lead 14 is connected. To the other end of the flexible electrical lead 40, a ring shaped connecting metal fitting 42 is connected. This connecting metal fitting 42 is fitted into the bore 13*a* provided in the electrical lead supporting portion 13. Thus, the connecting metal fitting 42 is in contact with the electrical lead 14. More particularly, the connecting metal fitting 42 is mounted on the electrical lead supporting portion 13 through a bolt 43 screw-threadedly connected to the metal fitting 15 so as to penetrate the bore 14*a* provided in the first electrical lead 14 and the connecting metal fitting 42.

As shown in FIGS. 1 and 4, the actuating mechanism 3 for effecting an opening operation of the vacuum interrupter 3 is mounted on the mounting metal fitting 7 so as to be positioned centrally adjacent the lower portion of each supporting pole 5. According to the embodiment, it is illustrated that an electromagnet is used serving as an actuating member of the actuating mechanism 3. The bottom portion of a cylindrical iron core 45 on which a winding 44 constituting the electromagnet is wounded is mounted on the mounting metal fitting 7 through a disk-shaped reinforced plate 46 of magnetic material by means of a bolt 47. The iron core 45 is provided concentrically with the insulating block 35 and the movable contact rod 25.

The winding 44 is clamped by a winding supporting portion 45*a* for clamping a winding 44, which is in contact with the armature 37 or away thereform and a reinforcing plate. The both ends of the winding supporting portion 45*a* is clamped by the end portion of two short poles and a pole 48 of a magnetic material screw-threadedly connected to the metal fitting 6. Each supporting pole 48 constitute a magnetic circuit together with the mounting metal fitting 7, the iron core 45, and the winding supporting portion 45*a*. Each supporting pole 48 is mounted on the mounting metal fitting 7 through a bolt 49.

The aforementioned vacuum power interrupting device is a so called "a self-closing type" wherein the stationary electrical contact 18 is in contact with the movable electrical contact 19 in an ordinary condition due to the pressure differential between the inside of the vacuum vessel 17 and the outside thereof.

In operation, when the winding 44 constituting the actuating mechanism 3 is energized, the armature 37 provided in the insulating resin block 35 is attrachted to thewinding supporting portion 45*a* of the iron core 45. Thus, the movable contact rod 25 integrally connected to the insulating resin block 35 is moved downwardly in FIG. 1. As a result, the movable electrical contact 19 is away from the stationary electrical contact 18. Thus, the vacuum power interrupting device is placed in open or an interrupted condition. When the winding 44 is de-energized, the vacuum power interrupting device is placed in a closed condition. Thus, this makes it possible to effectively improve the surface creepage flashover voltage at the insulating circular plate, thereby enabling to interrupt a high voltage when the vacuum interrupter is applied to the vacuum power interrupting device.

In the case of the single vacuum interrupter, the outer flashover voltage is A.C. 20 KV. On the contrary, in the case of the vacuum interrupter as part of the described power interrupting device, the surface creepage flashover voltage is A.C. 50 KV which is two times and half of the prior art vacuum interrupter.

Obviously, numerous modifications and variations of the present invention are possible in the light of the above teaching. It is therefore to be understood that within the scope of the appended claims, the invention may be practiced otherwise than as specifically described therein.

What is claimed is:

1. A vacuum power interrupting device with a vacuum vessel, the device including a vacuum interrupter comprising a stationary contact rod aligned with a movable contact rod, each said rod having, within the vacuum vessel, a respective electrical contact provided on an end of the associated rod extending into the vacuum vessel, the contact on the movable contact rod being in contact with or separated from the contact on the stationary contact rod, and the vacuum vessel comprising a bell-shaped metallic casing having a radially extending portion provided at an open end thereof, and an insulating circular end plate hermetically brazed to the open end of the metallic casing;

the vacuum interrupter being mounted on a supporting portion integrally formed with an insulating supporting member;

a clamping member serving as a cover member of said insulating supporting member and having a retaining member integrally formed therewith, said retaining member extending axially to said vacuum vessel and arranged to fit within said supporting portion; and a sealing member interposed between the vacuum vessel and said supporting portion, the axially extending end of said retaining member of said clamping member being pressed onto said radially extending portion of said bell-shaped casing in such a manner that the outer surface of the insulating end plate is in close contact with the surface of said supporting portion to affix the vacuum interrupter on said supporting portion.

2. A vacuum power interrupting device as defined in claim 1, wherein said insulating supporting member is made of a synthetic resin.

3. A vacuum power interrupting device as defined in claim 1, wherein said sealing member comprises a plurality of sealing rings.

4. A vacuum power interrupting device as defined in claim 1, which further comprises a cylindrical insulating barrier integrally formed with said insulating supporting member to surround said cylindrical retaining member.

5. A vacuum power interrupting device as defined in claim 1, wherein said insulating supporting member further comprises a first stationary lead serving as an output terminal.

6. A vacuum power interrupting device as defined in claim 5, wherein said clamping member is further provided with a second stationary lead integrally formed therewith and extending in parallel with said first stationary lead.

7. A vacuum power interrupting device as defined in claim 1, which further comprises an insulating resin block connected to the movable contact rod.

8. A vacuum power interrupting device as defined in claim 7, wherein said insulating resin block is provided with an armature.

9. A vacuum power interrupting device as defined in claim 7, wherein said insulating resin block is provided with an annular flange.

10. A vacuum power interrupting device as defined in claim 1, wherein said insulating supporting member is provided with a plurality of supporting poles extending axially to the vacuum interrupter.

11. A vacuum power interrupting device as defined in claim 1, which further comprises an actuating mechanism for actuating the movable contact rod.

12. A vacuum power interrupting device as defined by claim 8, wherein said actuating mechanism comprises an electromagnet, arranged along the axis of said insulating resin block and surrounded by a plurality of supporting poles integrally formed with said insulating supporting member and extending axially to the vacuum interrupter, said electromagnetic comprising an iron core and a winding wound on said iron core, said iron core being positioned opposite the said armature on said insulating resin block.

* * * * *